US006488001B2

(12) United States Patent
Suzuki et al.

(10) Patent No.: US 6,488,001 B2
(45) Date of Patent: Dec. 3, 2002

(54) ENGINE WITH SOUNDPROOF COVER OF INJECTOR

(75) Inventors: Koji Suzuki, Saitama (JP); Koji Kano, Saitama (JP); Akira Sonobata, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/820,212

(22) Filed: Mar. 29, 2001

(65) Prior Publication Data

US 2001/0025619 A1 Oct. 4, 2001

(30) Foreign Application Priority Data

Mar. 29, 1999 (JP) ..... 2000-091166

(51) Int. Cl.[7] ..... F02F 7/00
(52) U.S. Cl. ..... 123/195 C; 181/204
(58) Field of Search ..... 123/195 C, 198 E; 181/204

(56) References Cited

FOREIGN PATENT DOCUMENTS

| | | | |
|---|---|---|---|
| JP | 63-100269 | | 5/1988 |
| JP | 10-205410 | * | 8/1998 |
| JP | 11-82163 | | 3/1999 |
| JP | 2938204 | | 6/1999 |

* cited by examiner

*Primary Examiner*—Noah P. Kamen
(74) *Attorney, Agent, or Firm*—Birch, Stewart, Kolasch & Birch, LLP

(57) ABSTRACT

An injector is stored in a fixing block integrally formed with an intake manifold. A soundproof cover covers the entire electric supply terminal projecting from the injector in a lateral direction and the coupler connected to the plug. In addition, the soundproof cover brought into close contact with a fuel distribution pipe covering over top portions of a plurality of injectors to supply fuel and with the intake manifold to prevent operating sound from leaking out. Further, a hard material cover for covering the fixing block of the intake manifold, the soundproof cover and the fuel distribution pipe so as to improve its aesthetic appearance as well as its soundproof effect is also provided. This arrangement results in shutting off operating sound from an injector of an engine having a cylinder head projecting in a transverse direction of a vehicle body.

15 Claims, 7 Drawing Sheets

ENGINE WITH SOUNDPROOF COVER OF INJECTOR

BACKGROUND OF THE INVENTION

1. Field of the Invention

The present invention relates to an engine having a soundproof cover for an injector, and more particularly an engine having a soundproof cover for an injector having an improved soundproof effect as well as a superior outer appearance.

2. Background Art

A fuel injection device, i.e. an injector, is often used for injecting fuel into an intake pipe or intake manifold of an engine by opening or closing an electromagnetic valve at high speed. Typically, a hammering sound is generated when the valve is abutted against the valve seat in synchronization with the rotation of the engine.

Attempts in the conventional art have proposed providing an engine having an injection valve chamber storing the injection valve so as to prevent the hammering sound, i.e. the operating sound from leaking out of the engine (see Japanese Patent Laid-Open No. Sho 63-100269).

In addition, in the case of a motorcycle having an exposed engine, the operating sound of the injector is likely to leak out unlike that of an automobile having the entire injector accommodated in an engine compartment. In view of this fact, it has been proposed to provide an engine in which a soundproof countermeasure is applied by installing the injector within a space enclosed by peripheral component parts (for example, Japanese Patent Laid-Open No. Hei 11-82163 and Japanese Patent No. 2,938,204).

A system in which peripheral component parts surround an installed injector is preferable when the injector is mounted near a central part in a transverse direction of a vehicle body of the vehicle. However, in this case, it is hard to employ a layout in which the injector is preferably surrounded by peripheral component parts, in particular, in the case of a horizontal oriented engine or a V-shaped vertically oriented engine (an engine in which a plurality of cylinders with their crankshafts oriented longitudinally in forward and rearward directions of the vehicle body are opened in a shape of V in a transverse direction of the vehicle body).

In these cases, the injector is arranged at the outermost side of the vehicle body in its transverse (width) direction. Accordingly, since there are very few, if any, peripheral component parts capable of enclosing the injector, it is not possible to form a space sufficient to improve a soundproof effect.

In addition, since the cover provided with the injector installed at the outermost side of the vehicle body has a substantial influence on the outer appearance of the vehicle, it would be desirable to provide an adequate soundproof means having a satisfactory outer appearance.

SUMMARY OF THE INVENTION

The present invention overcomes the shortcomings associated with the related art and achieves other advantages not realized by the related art.

It is an aspect of the present invention to eliminate the aforesaid problems and provide an engine having a soundproof injector cover having a significant soundproof effect and also having a satisfactory outer appearance.

These and other aspects of the present invention are accomplished by a fuel injection engine comprising a soundproof cover for an injector fixed to an intake pipe at a predetermined angle; a fuel supply pipe connected to a top part of the injector; a coupler having a cable connected to an electric supply terminal for the injector projecting from between the intake pipe and the fuel supply pipe; and wherein the soundproof cover includes a resilient cover covering the coupler and arranged in a position in contact with the fuel supply pipe and the intake pipe.

These and other aspects of the present invention are accomplished by a fuel injection engine for a vehicle, the fuel injection engine comprising an air intake manifold; at least one fuel injector; an injector fixing block; a fuel supply pipe connected to a top portion of each injector via a fuel distribution pipe; and at least one coupler having a cable connected to an electric supply terminal for each injector projecting from between the air intake manifold and the fuel supply pipe; and a soundproof cover for each injector fixed to the air intake manifold and covering each coupler.

Accordingly, the exposed part of an injector is covered by a soundproof cover, the fuel supply pipe and the wall surface of the intake manifold, thereby making operating sound from the injector unlikely to leak out of the engine. Further, since the soundproof cover is such a small-sized unit for covering an electrical supplying connector and a cable, its aesthetic appearance can be kept desirable. Further, the soundproof cover can serve waterproof and dustproof effects.

Since the soundproof cover is also applied together with the cover for the electric supply terminal, the number of component parts is not increased.

Further, any portion that cannot be sufficiently covered by the aforesaid soundproof cover can be widely covered as well with an outer cover 50. The cover 50 can be covered with an ornamental design applied with plating or coating, for example. This will further improve its aesthetic appearance and further increase its commercial value.

Further, a soundproof effect is obtained in the situation where the injector is placed outside the vehicle body in a transverse direction, the operating sound is likely to be heard by the rider, and a fewer number of component parts acting as the soundproof wall is required.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not intended to limit the present invention to the embodiments shown, and wherein.

DETAILED DESCRIPTION OF THE PREFERRED EMBODIMENTS

Figure 1:
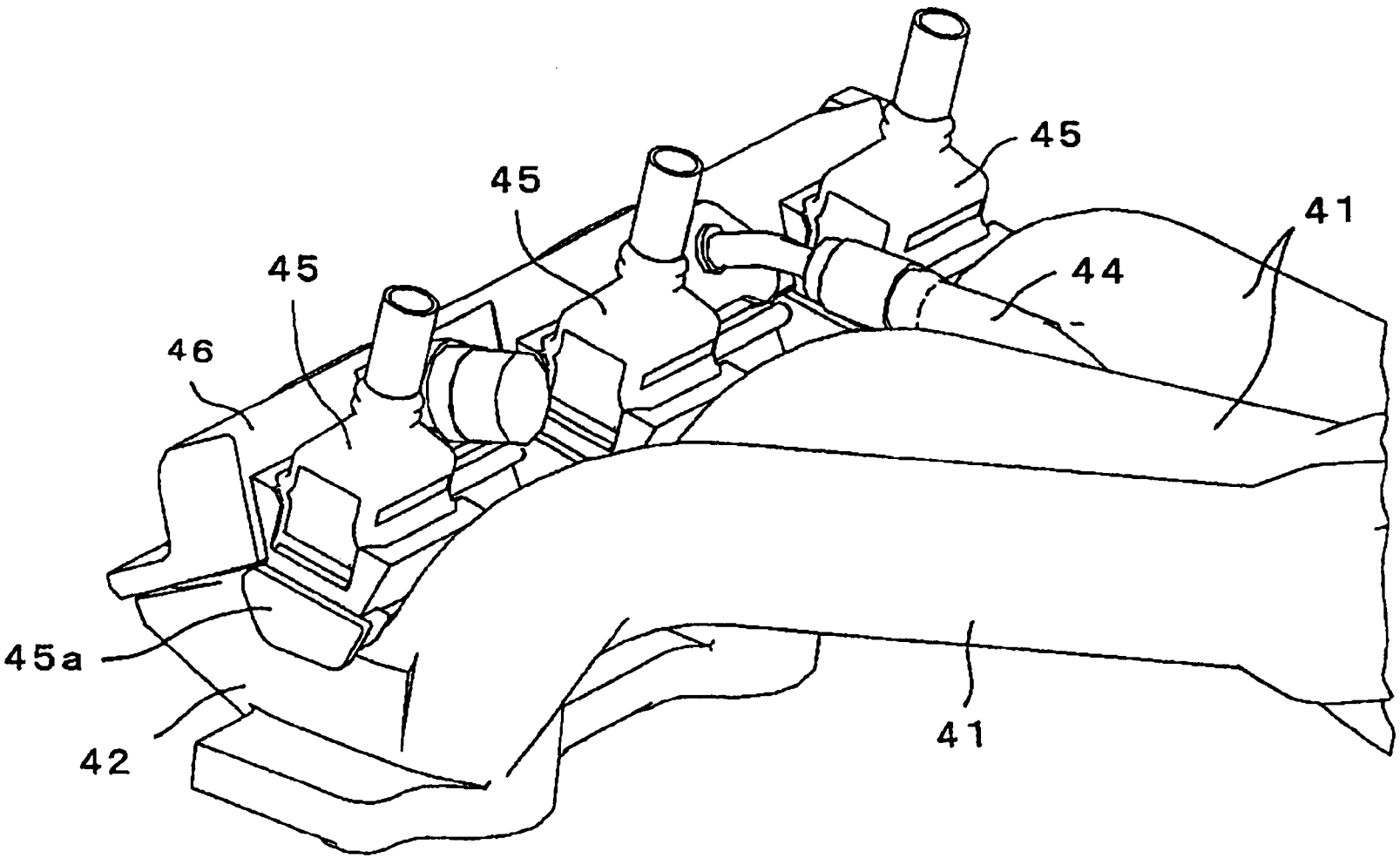
FIG. 1 is a perspective view according to an embodiment of the present invention.

Hereinafter, the present invention will be described in detail with reference to the accompanying drawings. Referring now to the drawings, a preferred embodiment of the invention will be described as follows.

Figure 2:
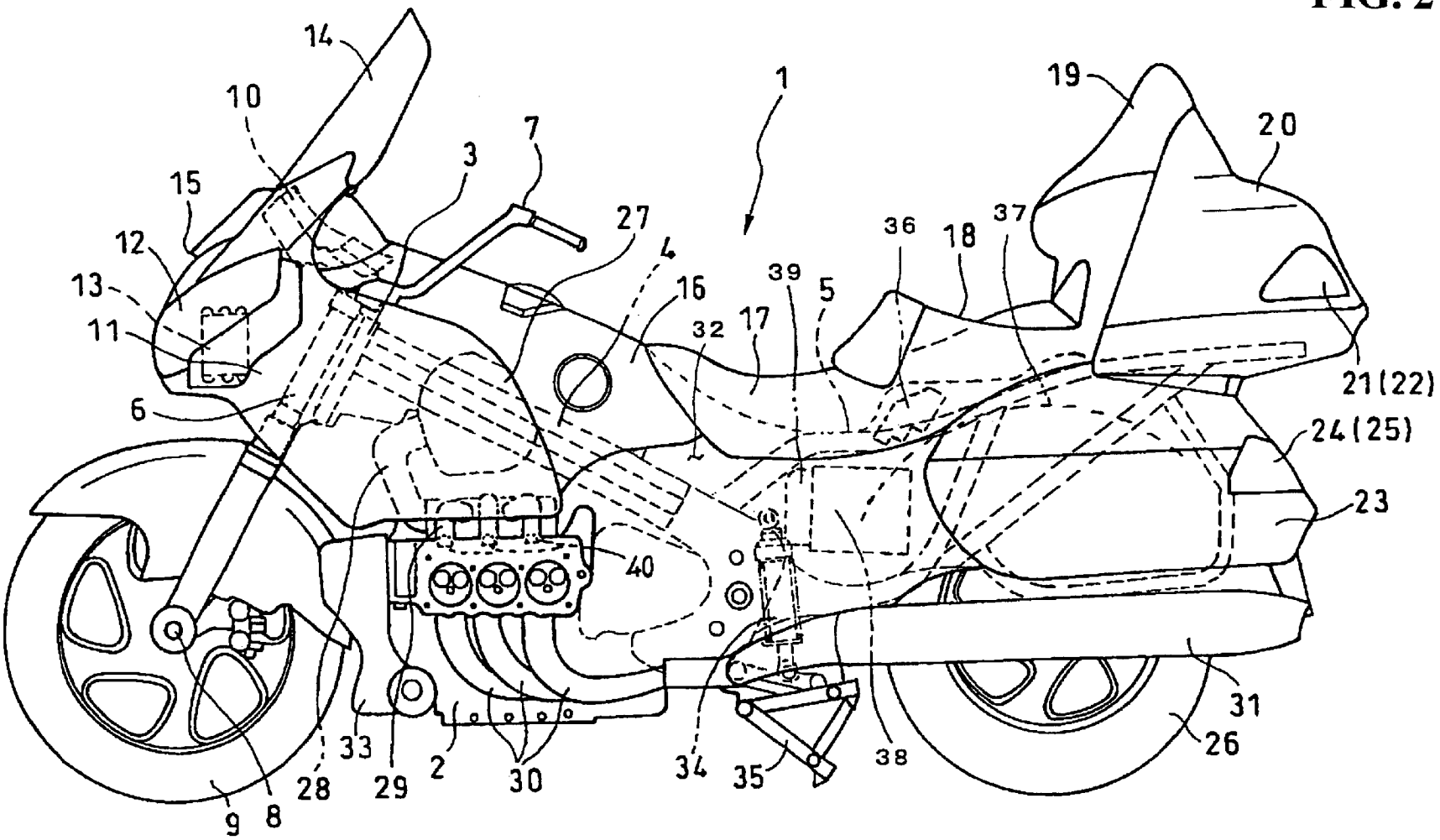
FIG. 2 is a side elevation view of a motorcycle with an engine according to an embodiment of the present invention.
Figure 3:
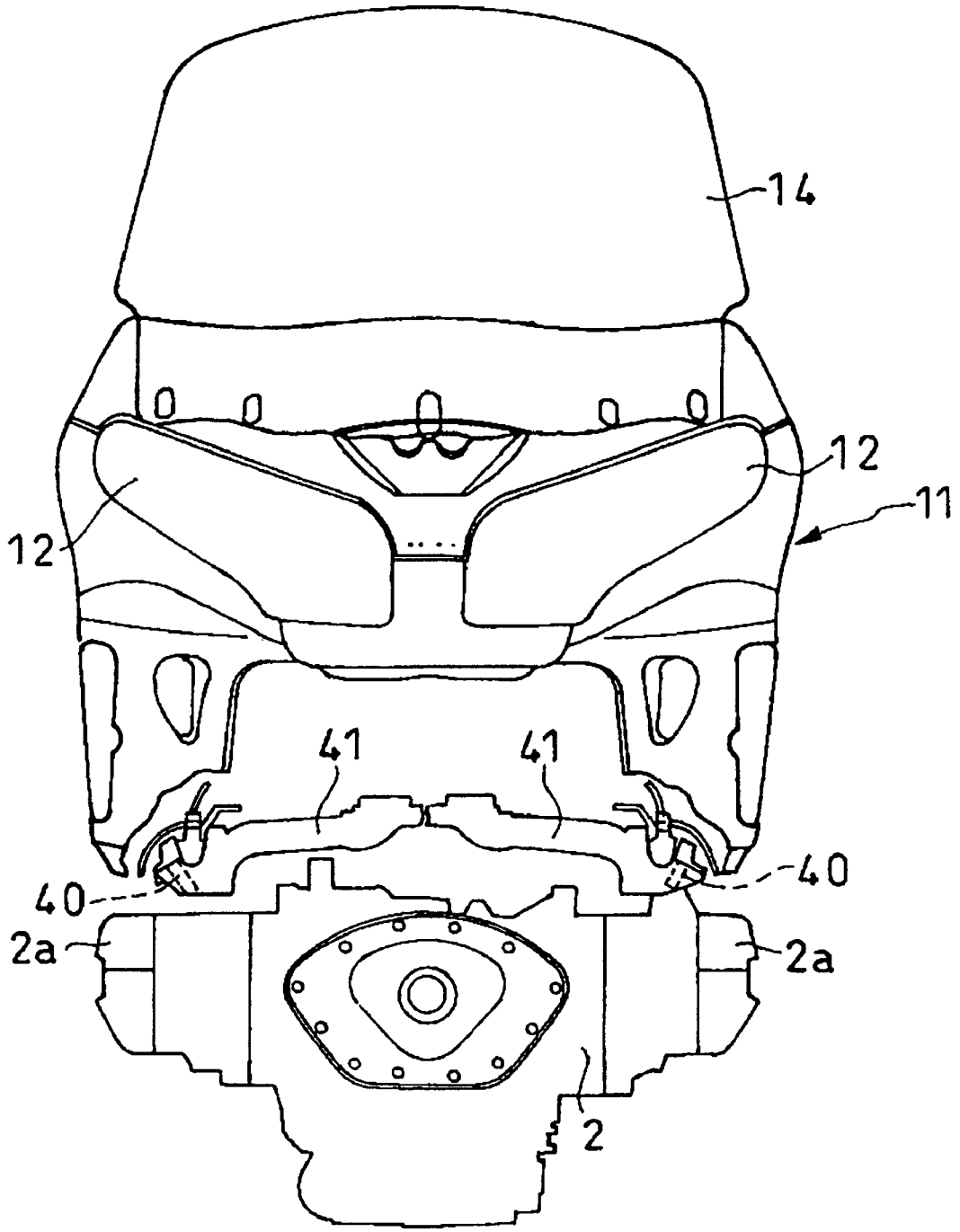
FIG. 3 is a front elevation view of the motorcycle in FIG. 2 according to an embodiment of the present invention.
Figure 4:
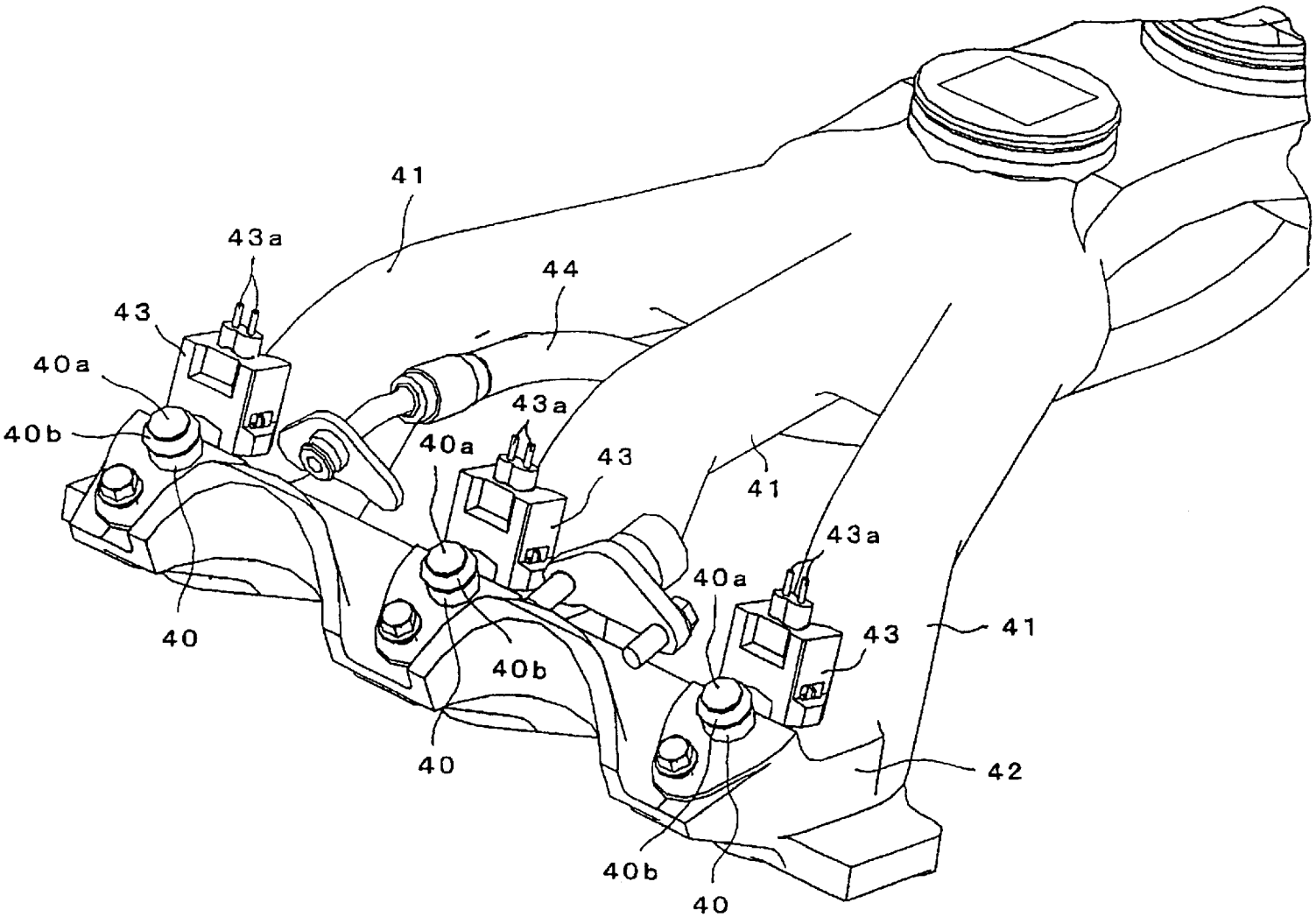
FIG. 4 is a perspective view showing portions surrounding an exposed injector according to an embodiment of the present invention.
Figure 5:
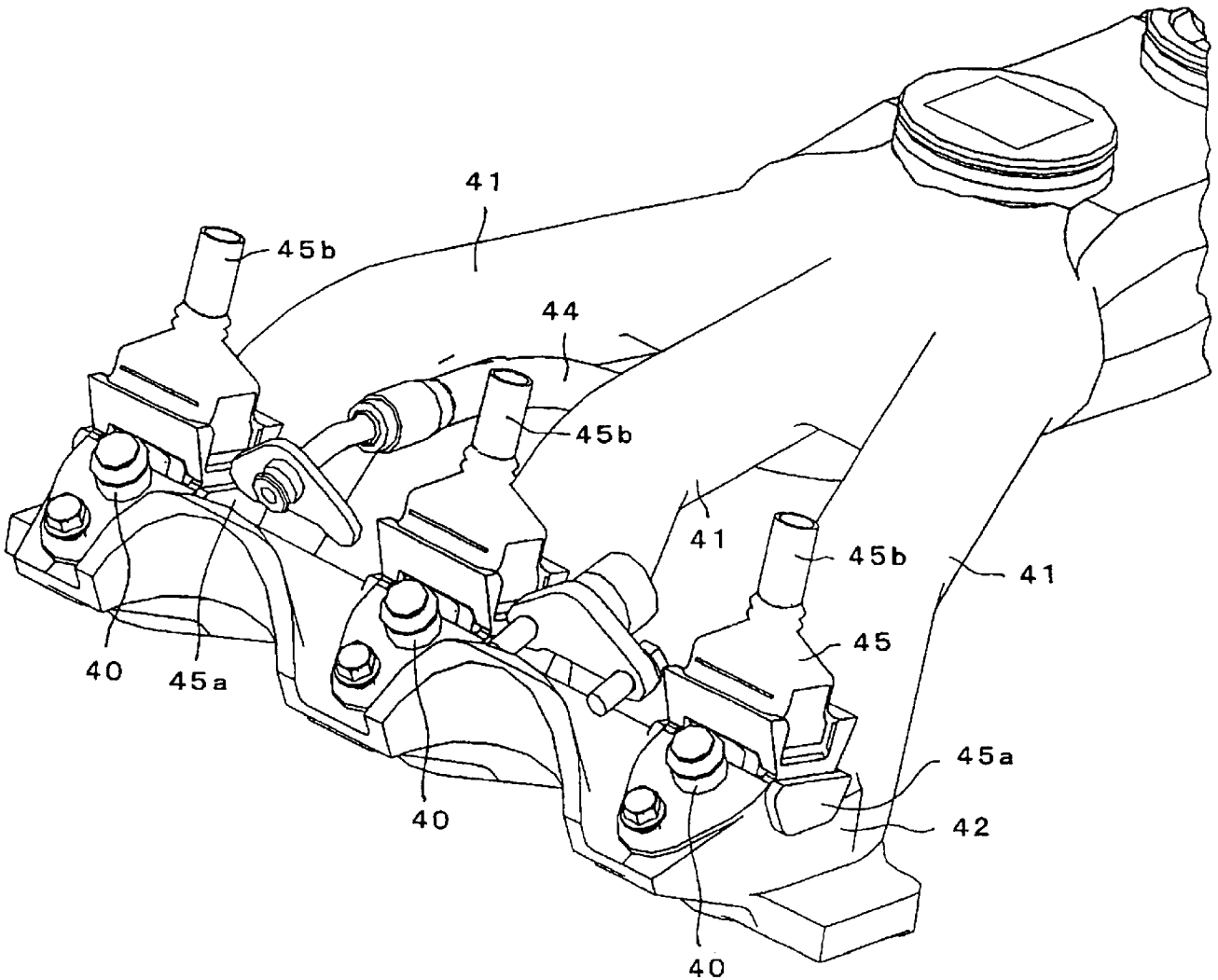
FIG. 5 is a perspective view showing portions surrounding an injector and having a soundproof cover according to an embodiment of the present invention.
Figure 6:
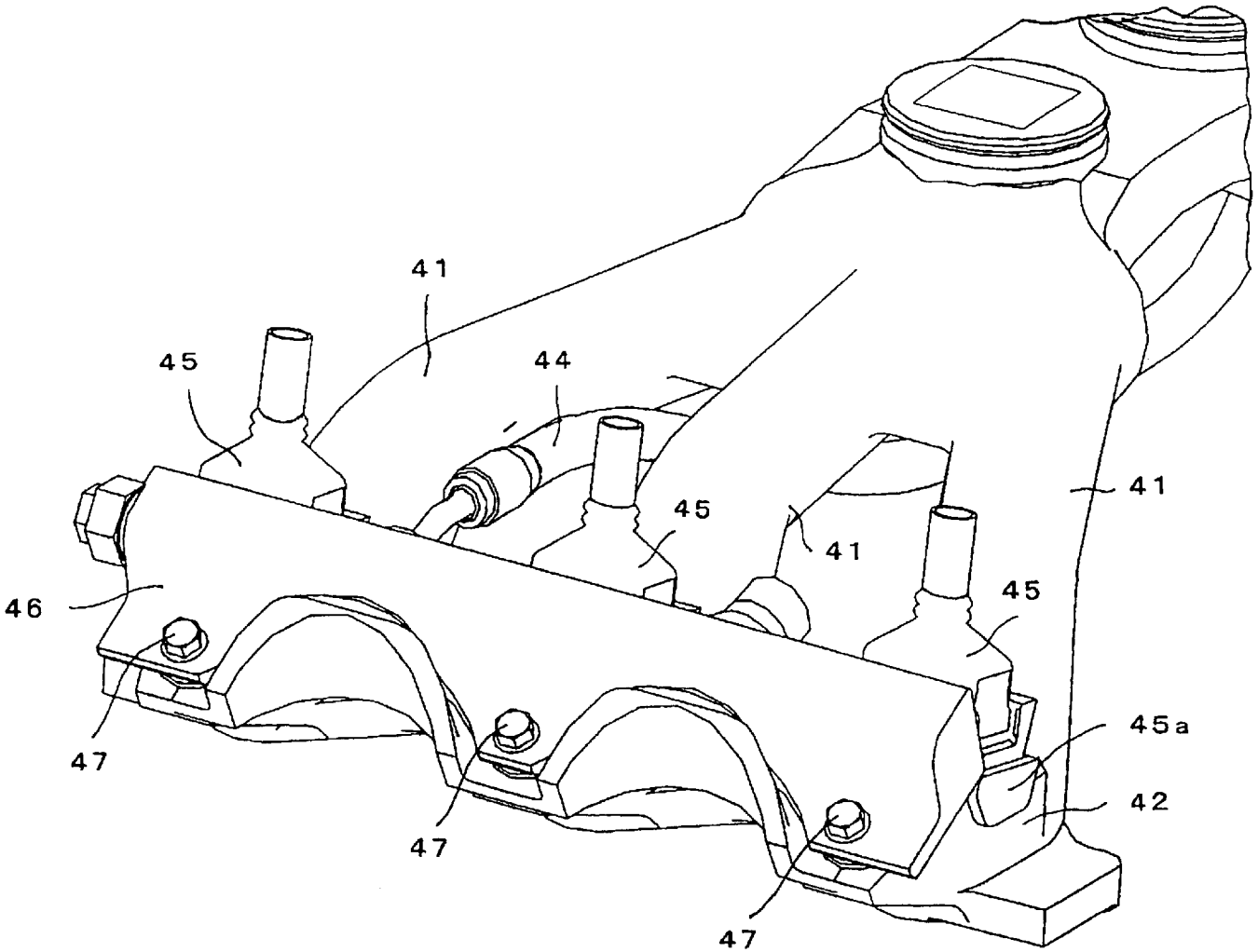
FIG. 6 is a perspective view from a side opposite to that of FIG. 1 showing a portion surrounding the injector of an engine according to an embodiment of the present invention.
Figure 7:
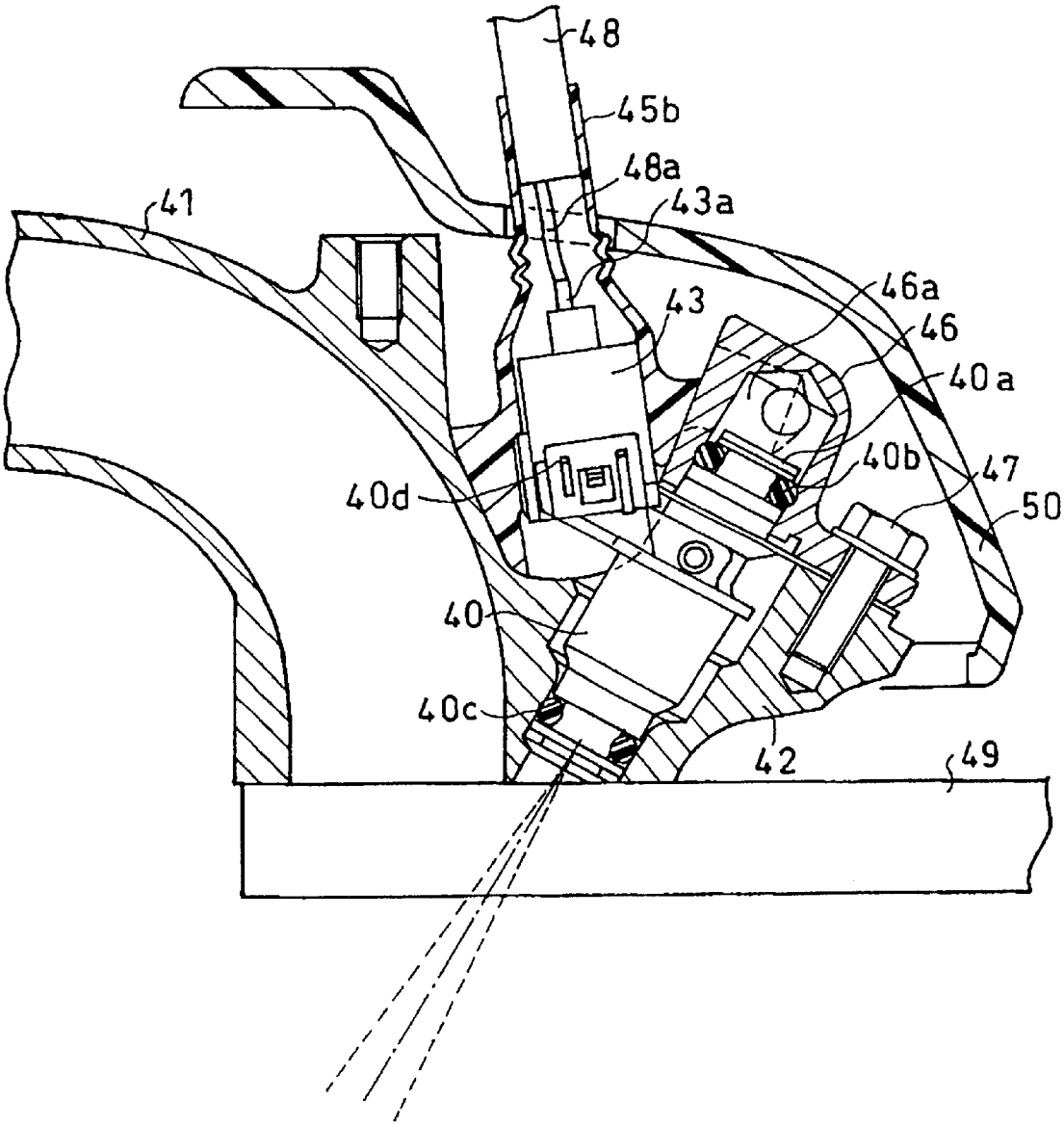
FIG. 7 is a sectional view of a portion surrounding an injector according to an embodiment of the present invention.

FIG. 1 is a perspective view according to an embodiment of the present invention. FIG. 2 is a side elevation view of a motorcycle with an engine having a soundproof injector cover mounted according to an embodiment of the present invention. FIG. 3 is a front elevation view of the motorcycle in FIG. 2 according to an embodiment of the present invention. FIG. 4 is a perspective view showing portions surrounding an exposed injector according to an embodiment of the present invention. FIG. 5 is a perspective view showing portions surrounding an injector and having a soundproof cover according to an embodiment of the present invention. FIG. 6 is a perspective view from a side opposite to that of FIG. 1 showing a portion surrounding the injector of an engine according to an embodiment of the present invention. FIG. 7 is a sectional view of a portion surrounding an injector according to an embodiment of the present invention.

In FIG. 3, a motorcycle or vehicle has a horizontally oriented, six-cylinder engine 2 mounted therein. Cylinder heads 2*a* of the engine 2 are positioned outside a vehicle body with respect to its transverse (width) direction, and injectors 40 are fixed to intake manifolds 41 near the cylinder heads 2*a*.

A frame of the vehicle 1 includes a twin-frame type main frame 4 extending from a steering head 3 to a rearward part of the vehicle divided in right and left directions. A rear frame 5 is connected from the main frame 4 in a rearward direction. A front fork 6 having two pipes arranged at right and left sides with respect to a running direction is pivotally supported at the steering head 3 in such a way that the vehicle can be steered.

A handlebar 7 is fixed to an upper part of the steering head 3, i.e. a top ridge. A front wheel 9 is rotatably supported at a front wheel shaft 8 arranged at the lower end of the front fork 6.

A display device is arranged at a front part of the handlebar 7. The display device includes a display panel or a control section, i.e. a meter unit 10. A lens 12 having a clear lens for a lighting device is fixed to the forward part of the front fairing (cowl) 11 that covers the front part of the vehicle 1.

A voltage-increasing device (ballast) 13 is stored within the front cowl 11 and is used for an electric discharge lamp of a lighting device. A windshield screen 14 is arranged at an upper part of the front cowl 11. An air feeding port 15 is formed near a fixing part of the wind shield screen 14.

A fuel tank 16 is arranged on the main frame 4, and a rider's seat 17 and an occupant's seat 18 are installed on the rear frame 5 in positions located behind the fuel tank. The occupant's seat 18 is integrally formed with the rider's seat 17 and also has a backrest 19.

A rear trunk 20 is arranged at a rear side of the backrest 19. At the rear part of the rear trunk 20 are arranged both a rear stop lamp 21 and a blinker light 22. Side trunks 23 are arranged below the rear trunk 20 and at both right and left sides of a rear wheel 26. Another set of rear stop lamp 24 and blinker lights 25 is arranged at rear parts of the side trunks 23.

An air cleaner 27 is arranged at a front lower part of the fuel tank 16, and an intake manifold 29 extends from a throttle body 28 mounted at a front part of the air cleaner 27. The intake manifold 29 is connected to three cylinders, each of which is oppositely arranged at the right and left sides of the vehicle body. Injectors 40 are also installed at each of these cylinders.

A soundproof cover simultaneously acting as a cover for an electrical supply connector is applied to cover the injectors 40. The details of the soundproof cover will be described hereinafter. Exhaust manifolds 30 are drawn out of the engine 2 in a rearward direction and are connected to a muffler 31.

Side covers 32 cover both lower sides of the rider's seat 17. A front lower cowl 33 is arranged at a forward side of the engine 2. In addition, a relay box 36 is installed along a rear fender 37 below the rider's seat 17. The relay box 36 is fixed on the rear fender 37.

A battery 38 is installed at the left side of the vehicle body below the relay box 36. A fuse box 39 is arranged at a front side of the battery 38. The battery 38 is mounted on a supporting frame suspended at the rear frame, and the fuse box 39 is fixed to the supporting frame with screws.

Further, a rear cushion 34 is provided below the rider's seat 17. This rear cushion 34 is connected to a hydraulic unit (not shown) capable of adjusting an initial load of a suspension in response to a physical weight of a rider by electrically adjusting a spring force. The vehicle 1 can be stored in an upright position with application of a stand 35.

A configuration around the engine head, including the injectors, will be described hereinafter. FIG. 4 is a perspective view for showing a portions around the engine head according to an embodiment of the present invention. In this figure, the injector side or extreme ends of the intake manifolds 41 branch into three segments (or as many as necessary in response to the number of cylinders of the corresponding engine) and are fixed to an injector fixing block 42 extending along an longitudinal direction of the cylinders. The intake manifolds 41 and the injector fixing block 42 can be integrally formed as one piece.

Three injectors 40 are installed at the injector fixing block 42 in compliance with the number of cylinders. The injectors 40 are installed with the fuel injection ports directed toward the center of the intake manifolds 41.

The fuel supplying ports 40*a* at their top portions protrude out of the fixing block 42 in an upward direction. An O-ring 40*b* is arranged around the fuel supplying port 40*a*. A fuel distribution pipe is installed at the fuel supplying port 40*a* and is held in position by the O-ring 40*b*.

The injector 40 is provided with an electric supply plug. A coupler 43 is connected to this electric supply plug. A conductive wire constituting a wire harness is connected to the terminal 43*a* of the coupler 43.

In addition, a fuel hose 44 connected to the fuel distribution pipe for supplying fuel is extended from the same direction as that of the intake manifold 41.

FIG. 5 is a perspective view showing a portion surrounding an engine head with a soundproof cover fixed to each coupler 43. In this figure, a soundproof cover 45 is applied to cover each of the couplers 43 (refer to FIG. 7) and is used for fully covering the coupler 43. In a preferred embodiment, the soundproof covers 45 are made from a resilient, soft heat-resistant rubber, such as chloroprene rubber or silicone rubber.

The soundproof cover 45 has a skirt section 45*a* covering a side surface of each coupler 43. Each of the front surface and the rear surface (the surface of the intake manifold) crossing at a right angle with the skirt section 45*a* is formed to be closely brought into contact with an outer circumference of the fuel distribution pipe and the intake manifold 41.

In addition, a tube portion 45*b* at the upper part of the soundproof cover 45 is of a cylindrical shape to be closely brought into contact with an outer shape of the wire harness. Since the soundproof cover 45 is made to cover the entire coupler while also being closely in contact with it, operating sounds from the injector 40 are shielded. At the same time it is possible to implement and achieve waterproof and dustproof connections.

FIGS. 1 and 6 are perspective views showing portions surrounding an engine head in which the fuel distribution pipe is fixed. FIG. 1 is a perspective view according to an embodiment of the present invention. FIG. 6 is a perspective view from a side opposite to that of FIG. 1 showing a portion surrounding the injector of an engine according to an embodiment of the present invention.

In both figures, the fuel distribution pipe 46 serving a fuel distribution function is a long block extending in an longitudinal direction of the three injectors 40 injector fixing block 42. The fuel distribution pipe 46 has a fuel passage (not shown) extending in its longitudinal direction. Further, each fuel passage is fixedly connected to the fuel supplying port 40*a* of each of the injectors 40.

The fuel distribution pipe 46 is fixed to the fixing block 42 with three bolts 47. In addition, the fuel hose 44 is connected from the intake manifold 41 to the side surface of the fuel distribution pipe 46. Therefore, the top part of each injector 40 is exposed out of the fixing block 42 and is covered by the fuel distribution pipe 46. The plug at the outward projected side, i.e. the electric supply terminal, is covered by the soundproof cover 45 brought into close contact with the fuel distribution pipe 46. This arrangement results in complete elimination of the portion exposed to the outside portion.

FIG. 7 is a sectional view showing an injector fixing portion according to an embodiment of the present invention. In this figure, the intake manifold 41 including the fixing block 42 is fixed to the engine head. The injector 40 is installed in a hole of the fixing block 42 with a liquid-tight state being maintained by the O-ring 40*c*.

The fuel supplying port 40*a* is fitted to and inserted into the hole 46*a* of the fuel distribution pipe 46 with a liquid-tight state being maintained by the O-ring 40*b*. The plug 40*d* acting as the electric supply terminal is extended at the side of the injector 40. The coupler 43 is connected to the plug 40*d* and a conductive wire 48*a* of the wire harness 48 is connected to the terminal 43*a* of the coupler 43.

The soundproof cover 45 covers the coupler 43, and the upward extending tube portion 45*b* is closely brought into contact with the wire harness 48.

Although the operational sound shielding effect at the injector 40 achieved by the soundproof cover 45 is substantially high, it is possible to additionally arrange an outer surface cover 50 covering the injector 40, coupler 43, soundproof cover 45 and fuel distribution pipe 46. This outer surface cover 50 can serve the function of protecting the coupler 43 or the injector 40 facing toward the outermost side in the transverse direction of the vehicle body while simultaneously improving aesthetic appearance.

In view of this fact, it is preferable that the outer surface cover 50 be made of hard material such as aramid fiber and melamine resin. In addition, it is preferable that the cover 50 have an ornamental design(s) having high commodity characteristics under application of plating or coating and the like.

Further, in the aforesaid preferred embodiment, the engine having horizontally oriented cylinders has been described with reference to a vertically oriented engine in which an output shaft extends in a forward or rearward direction of the vehicle body. However, the invention is not limited to a system in which the cylinders are oppositely arranged in a horizontal orientation, and can be used in an engine in which the cylinder head is projected out in a transverse direction of the vehicle body and the intake manifold is connected from above the cylinder head. Further, the invention is not necessarily limited to a system in which the cylinders are oppositely faced.

As apparent from the foregoing description, the exposed part of the injector is covered by a soundproof cover, the fuel supply pipe and the wall surface of the intake manifold, thereby making operating sound from the injector unlikely to leak out of the engine. Further, since the soundproof cover is such a small-sized unit for covering an electrical supplying connector and a cable, its aesthetic appearance can be kept desirable. Further, the soundproof cover can serve waterproof and dustproof effects.

Since the soundproof cover is also applied together with the cover for the electric supply terminal, the number of component parts is not increased.

Further, any portion that cannot be sufficiently covered by the aforesaid soundproof cover can be widely covered as well with an outer cover 50. The cover 50 can be covered with an ornamental design applied with plating or coating, for example. This will further improve its aesthetic appearance and further increase its commercial value.

Further, a soundproof effect is obtained in the situation where the injector is placed outside the vehicle body in a transverse direction, the operating sound is likely to be heard by the rider, and a fewer number of component parts acting as the soundproof wall is required.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel injection engine comprising:

a soundproof cover for an injector fixed to an intake pipe at a predetermined angle;

a fuel supply pipe connected to a top part of said injector;

a coupler having a cable connected to an electric supply terminal for the injector projecting from between said intake pipe and said fuel supply pipe; and wherein said soundproof cover includes a resilient cover covering said coupler and arranged in a position in contact with said fuel supply pipe and said intake pipe, a hard material cover covering said fuel supply pipe, and a skirt section covering a side surface of said coupler.

2. The fuel injection engine according to claim 1 further comprising:

an output shaft extending in forward and rearward directions of a vehicle body;

a cylinder head expanding outward in a transverse direction of the vehicle body; and the intake pipe is mounted and connected to said cylinder head at an upper portion thereof.

3. The fuel injection engine according to claim 1, wherein said hard material cover includes an outer surface cover covering each injector, each coupler, each respective soundproof cover and said fuel distribution pipe.

4. A fuel injection engine comprising:

a soundproof cover for an injector fixed to an intake pipe at a predetermined angle, wherein said intake pipe further includes an injector fixing portion of said intake pipe;

a fuel supply pipe connected to a top part of said injector;

a coupler having a cable connected to an electric supply terminal for the injector projecting from between said intake pipe and said fuel supply pipe; wherein said soundproof cover includes a resilient cover covering said coupler and arranged in a position in contact with said fuel supply pipe and said intake pipe, and wherein said soundproof cover is made of a resilient, soft, heat-resistant rubber, said resilient cover and a hard material covering said fuel supply pipe; wherein said hard material cover includes an outer surface cover covering each injector, each coupler, each respective soundproof cover and said fuel supply pipe;

an output shaft extending in forward and rearward directions of a vehicle body; and a cylinder head expanding outward in a transverse direction of the vehicle body; wherein the intake pipe is mounted and connected to said cylinder head at an upper portion thereof.

5. The fuel injection engine according to claim 4, wherein said resilient, soft, heat-resistant rubber is chloroprene rubber or silicone rubber.

6. The fuel injection engine according to claim 5, wherein the soundproof cover has a skirt section covering a side surface of said coupler.

7. The fuel injection engine according to claim 6, wherein a tubular portion formed at an upper part of the soundproof cover contacts an outer shape of a wire harness of said coupler.

8. A fuel injection engine for a vehicle, said fuel injection engine comprising:

an air intake manifold;

at least one fuel injector;

an injector fixing block;

a fuel supply pipe connected to a top portion of each injector via a fuel distribution pipe; and at least one coupler having a cable connected to an electric supply terminal for each injector projecting from between said air intake manifold and said fuel supply pipe;

a soundproof cover for each injector fixed to the air intake manifold and covering each coupler, wherein said soundproof cover includes a resilient cover arranged in a position in contact with said fuel supply pipe and said air intake manifold, said resilient cover and a hard material covering said fuel supply pipe; and said hard material cover including an outer surface cover covering each injector, each coupler, each respective soundproof cover and said fuel supply pipe.

9. The fuel injection engine according to claim 8, wherein said resilient, soft, heat-resistant rubber is chloroprene rubber or silicone rubber and said hard material cover is made of aramid fiber and melamine resin.

10. The fuel injection engine according to claim 9, wherein the soundproof cover has a skirt section covering a side surface of said coupler.

11. A fuel injection engine for a vehicle, said fuel injection engine comprising:

an air intake manifold;

at least one fuel injector;

an injector fixing block;

a fuel supply pipe connected to a top portion of each injector via a fuel distribution pipe; and at least one coupler having a cable connected to an electric supply terminal for each injector projecting from between said air intake manifold and said fuel supply pipe;

a soundproof cover for each injector fixed to the air intake manifold and covering each coupler, wherein said soundproof cover includes a resilient cover arranged in a position in contact with said fuel supply pipe and said air intake manifold, said resilient cover and a hard material covering said fuel supply pipe; and a tubular portion formed at an upper part of the soundproof cover and contacting an outer shape of a wire harness of said coupler.

12. The fuel injection engine according to claim 11 further comprising:

an output shaft extending in forward and rearward directions of a vehicle body;

a cylinder head expanding outward in a transverse direction of the vehicle body; and the intake manifold is mounted and connected to said cylinder head at an upper portion thereof.

13. The fuel injection engine according to claim 12, wherein said soundproof cover is made of a resilient, soft, heat-resistant rubber.

14. The fuel injection engine according to claim 13, wherein said resilient, soft, heat-resistant rubber is chloroprene rubber or silicone rubber and said hard material cover is made of aramid fiber and melamine resin.

15. The fuel injection engine according to claim 14, wherein the soundproof cover has a skirt section covering a side surface of said coupler.

* * * * *